US008331840B2

(12) United States Patent
Someya et al.

(10) Patent No.: US 8,331,840 B2
(45) Date of Patent: Dec. 11, 2012

(54) FIXING DEVICE AND IMAGE FORMING APPARATUS USING INTERDIGITATED ROLLERS

(75) Inventors: Yukimichi Someya, Saitama (JP); Kunihiko Tomita, Yokohama (JP); Satoshi Muramatsu, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 316 days.

(21) Appl. No.: 12/801,238

(22) Filed: May 28, 2010

(65) Prior Publication Data

US 2010/0310289 A1 Dec. 9, 2010

(30) Foreign Application Priority Data

Jun. 3, 2009 (JP) ..... 2009-134065

(51) Int. Cl.
*G03G 15/20* (2006.01)

(52) U.S. Cl. ..... 399/329

(58) Field of Classification Search ..... 399/328, 399/329, 331; 219/216
See application file for complete search history.

(56) References Cited

U.S. PATENT DOCUMENTS

| | | | | |
|---|---|---|---|---|
| 5,873,020 | A * | 2/1999 | Matsuura et al. | 399/329 |
| 6,370,352 | B1 | 4/2002 | Tomita | |
| 6,577,840 | B2 * | 6/2003 | Hachisuka et al. | 399/329 |
| 6,623,897 | B2 | 9/2003 | Tomita | |
| 6,757,514 | B2 * | 6/2004 | Berkes et al. | 399/329 |
| 6,778,788 | B2 | 8/2004 | Tomita et al. | |
| 6,785,504 | B2 * | 8/2004 | Yasui et al. | 399/329 |
| 6,939,614 | B2 | 9/2005 | Tomita | |
| 7,046,949 | B2 | 5/2006 | Tomita et al. | |
| 7,139,520 | B2 | 11/2006 | Echigo et al. | |
| 7,254,360 | B2 | 8/2007 | Tomita | |
| 7,352,987 | B2 | 4/2008 | Iwata et al. | |
| 7,356,298 | B2 | 4/2008 | Tomita et al. | |
| 7,590,376 | B2 | 9/2009 | Tomita et al. | |
| 7,702,273 | B2 * | 4/2010 | Ishida et al. | 399/329 |
| 2001/0006583 | A1 | 7/2001 | Tomita | |
| 2002/0031363 | A1 | 3/2002 | Tomita et al. | |
| 2003/0059224 | A1 | 3/2003 | Tomita et al. | |

(Continued)

FOREIGN PATENT DOCUMENTS

JP 05-127551 A 5/1993

(Continued)

OTHER PUBLICATIONS

English language abstract of JP-2003-228253 which corresponds to Japanese Patent No. 4298272.

*Primary Examiner* — Robert Beatty
(74) *Attorney, Agent, or Firm* — Harness, Dickey & Pierce, P.L.C.

(57) ABSTRACT

In a fixing device, a first roller and a first fixing member are provided inside a loop formed by a first belt. A pressing member is pressed against the first roller and the first fixing member via the first belt. The first roller includes at least two enlarged radius portions of enlarged radius arranged axially along the first roller, at least one reduced radius portion of reduced radius sandwiched between the adjacent two enlarged radius portions in an axial direction of the first roller, and a concave portion formed by the reduced radius portion and the adjacent two enlarged radius portions sandwiching the reduced radius portion. The first fixing member is interdigitated with the first roller with play between the first fixing member and the first roller.

16 Claims, 9 Drawing Sheets

U.S. PATENT DOCUMENTS

| | | | | |
|---|---|---|---|---|
| 2003/0207194 | A1 | 11/2003 | Tomita | |
| 2004/0033431 | A1 | 2/2004 | Tomita | |
| 2005/0025537 | A1 | 2/2005 | Echigo et al. | |
| 2005/0232664 | A1 | 10/2005 | Tomita | |
| 2006/0159477 | A1 | 7/2006 | Tomita et al. | |
| 2006/0171749 | A1 | 8/2006 | Tomita et al. | |
| 2008/0138130 | A1* | 6/2008 | Park et al. | 399/329 |
| 2009/0154967 | A1 | 6/2009 | Tomita | |
| 2010/0239337 | A1 | 9/2010 | Muramatsu et al. | |

FOREIGN PATENT DOCUMENTS

| | | | |
|---|---|---|---|
| JP | 09-138598 | A | 5/1997 |
| JP | 09-218601 | A | 8/1997 |
| JP | 2002-251088 | A | 9/2002 |
| JP | 2003-005566 | A | 1/2003 |
| JP | 2004-093753 | A | 3/2004 |
| JP | 2005-031660 | A | 2/2005 |
| JP | 2005-173448 | A | 6/2005 |
| JP | 4298272 | B2 | 4/2009 |

* cited by examiner

FIXING DEVICE AND IMAGE FORMING APPARATUS USING INTERDIGITATED ROLLERS

PRIORITY STATEMENT

The present patent application claims priority from Japanese Patent Application No. 2009-134065, filed on Jun. 3, 2009 in the Japan Patent Office, which is hereby incorporated herein by reference in its entirety.

BACKGROUND OF THE INVENTION

1. Field of the Invention

Example embodiments generally relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

When such fixing device is installed in a color image forming apparatus for forming a color toner image on a recording medium, the fixing device is required to apply heat to the color toner image in an amount sufficient to apply gloss to the toner image on the recording medium with shortened warm-up time. To address this requirement, the fixing device may include a belt that contacts the recording medium bearing the toner image to apply heat to the recording medium. The belt may have a smaller thermal capacity compared to a roller, and therefore may be heated faster than the roller. Moreover, the belt may be laid over a plurality of rollers to lengthen a fixing nip defined by and between the belt pressing against a parallel pressing member and through which the recording medium bearing the toner image passes to enable the fixing device to fix the toner image on the recording medium.

FIGS. 1A and 1B illustrate a fixing device 11R including such belt configuration. A belt 22R is laid over a first roller 20R and a second roller 21R. A pressing member 25R disposed opposite the first roller 20R and the second roller 21R presses against the first roller 20R and the second roller 21R via the belt 22R. The first roller 20R and the second roller 21R disposed adjacent to the first roller 20R may form a substantially flat nip N of great length represented by a combination of a nip section N1 formed between the first roller 20R and the pressing member 25R via the belt 22R, a nip section N2 formed between the belt 22R and the pressing member 25R, and a nip section N3 formed between the second roller 21R and the pressing member 25R via the belt 22R. The great length of the nip N may allow the belt 22R to contact the recording medium for a longer time to apply a greater amount of heat to the recording medium passing through the nip N, which is desirable for good fixation of the toner image on the recording medium. In addition, the flatness of the nip N may prevent any difference between the linear velocity at the nip N of the belt 22R facing the front side of the recording medium, which bears the toner image, and the linear velocity of the pressing member 25R facing the back side of the recording medium, which does not bear the toner image, thus suppressing image shift of the toner image on the recording medium.

However, at the intermediate nip section N2, the pressing member 25R is not pressed against the first roller 20R and the second roller 21R. Accordingly, the pressing member 25R presses the recording medium against the belt 22R with reduced pressure at the nip section N2 compared to the nip sections N1 and N3, resulting in variation in pressure applied at the nip sections N1, N2, and N3.

To address this problem, the fixing device 11R may be configured so that the pressing member 25R applies greater pressure on the belt 22R. However, the greater pressure may degrade durability of both the pressing member 25R and the belt 22R. Alternatively, the first roller 20R and the second roller 21R may be given greater radii, that is, made larger. However, generally the larger the first roller 20R and the second roller 21R the greater their thermal capacity, resulting in increased warm-up time of the upsized fixing device.

SUMMARY

At least one embodiment provides a fixing device that includes a first belt, a first roller, a first fixing member, and a pressing member. The first belt has an endless belt shape to rotate in a predetermined direction of rotation. The first roller is provided inside a loop formed by the first belt. The first fixing member is provided inside the loop formed by the first belt and is disposed adjacent to the first roller. The pressing member is pressed against the first roller and the first fixing member via the first belt.

The first roller includes at least two enlarged radius portions of enlarged radius arranged axially along the first roller, at least one reduced radius portion of reduced radius sandwiched between the adjacent two enlarged radius portions in an axial direction of the first roller, and a gap portion formed by the reduced radius portion and the adjacent two enlarged radius portions sandwiching the reduced radius portion. The first fixing member is interdigitated with the first roller with play between the first fixing member and the first roller.

At least one embodiment provides an image forming apparatus for forming a toner image on a recording medium that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1B:
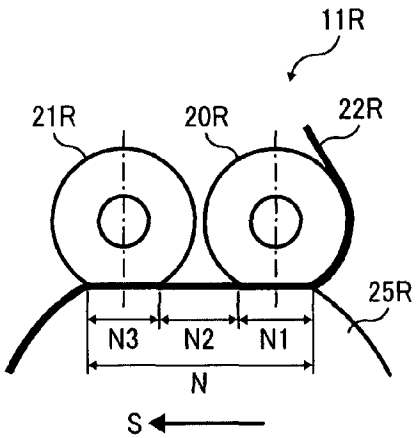
FIG. 1B RELATED ART
FIG. 1B is a schematic sectional view of the related-art fixing device shown in FIG. 1A seen from a direction E shown in FIG. 1A.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 2:
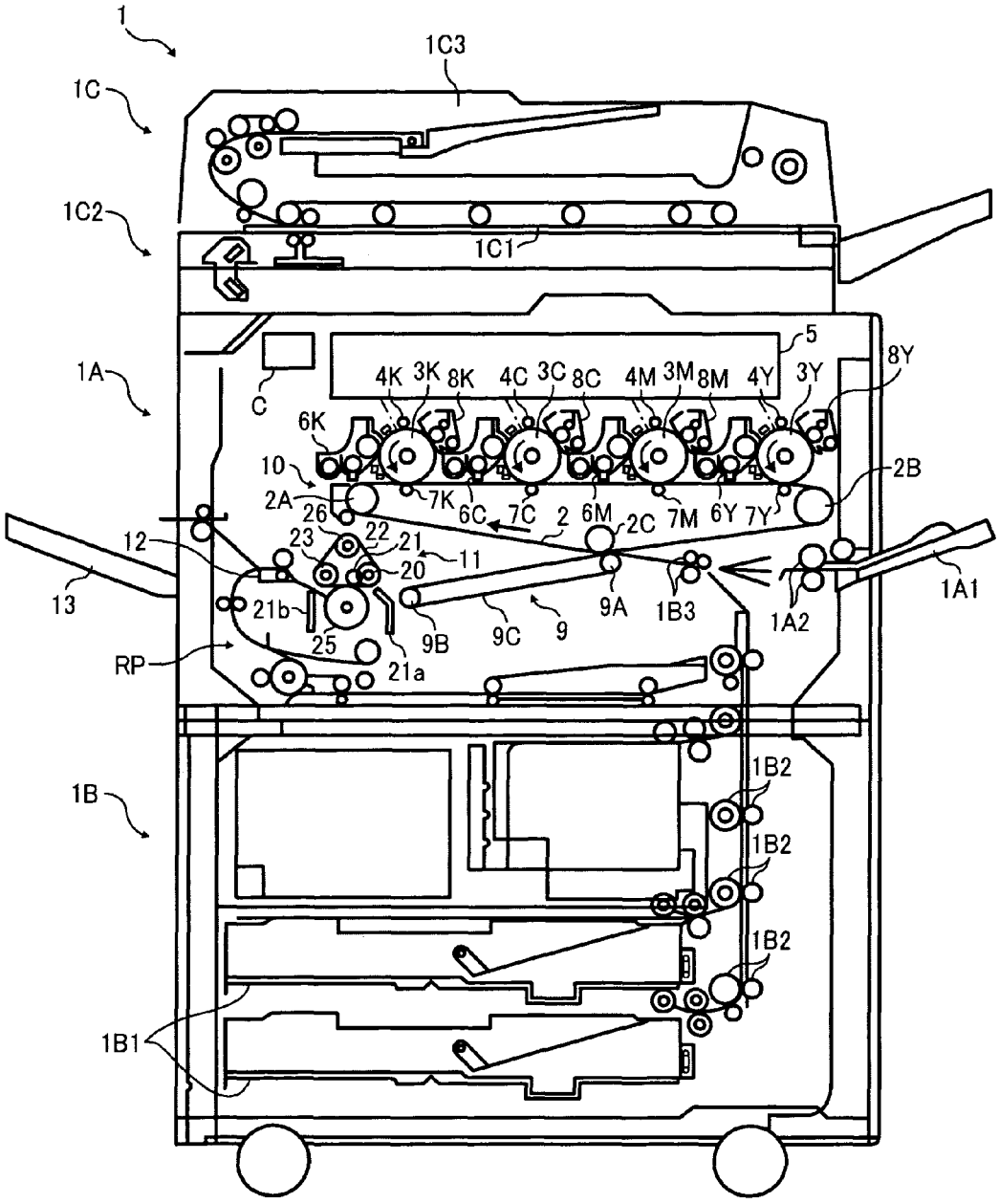
FIG. 2 is a schematic view of an image forming apparatus according to an example embodiment.

Referring now to the drawings, wherein like reference numerals designate identical or corresponding parts throughout the several views, particularly to FIG. 2, an image forming apparatus 1 according to an example embodiment is explained.

FIG. 2 is a schematic view of the image forming apparatus 1. As illustrated in FIG. 2, the image forming apparatus 1 includes an image forming device 1A, a sheet supplier 1B, and an original document scanner 1C.

The image forming device 1A includes an intermediate transfer belt 2, rollers 2A, 2B, and 2C, photoconductors 3Y, 3M, 3C, and 3K, chargers 4Y, 4M, 4C, and 4K, a writer 5, development devices 6Y, 6M, 6C, and 6K, first transfer devices 7Y, 7M, 7C, and 7K, cleaners 8Y, 8M, 8C, and 8K, a second transfer device 9, a belt cleaner 10, a fixing device 11, a path selection pawl 12, an output tray 13, a controller C, and a reverse conveyance path RP. The second transfer device 9 includes a driving roller 9A, a driven roller 9B, and a transfer belt 9C. The fixing device 11 includes a guide roller 20, a rotary roller 21, an entry guide plate 21*a*, an output guide plate 21*b*, a fixing belt 22, a driving roller 23, a pressing roller 25, and a heating roller 26.

The sheet supplier 1B includes a bypass tray 1A1, a feed roller pair 1A2, sheet trays 1B1, conveyance roller pairs 1B2, and a registration roller pair 1B3.

The original document scanner 1C includes an exposure glass 1C1, a scanner 1C2, and an auto document feeder 1C3.

The image forming apparatus 1 may be a copier, a facsimile machine, a printer, a multifunction printer having at least one of copying, printing, scanning, and facsimile functions, or the like. According to this example embodiment, the image forming apparatus 1 is a color copier for forming a color image on a recording medium. For example, the image forming apparatus 1 includes a plurality of photoconductors on which toner images corresponding to separation colors are formed, respectively, an intermediate transfer member on which the toner images formed on the photoconductors are transferred and superimposed, and a second transfer member which transfers the toner images superimposed on the intermediate transfer member onto a recording medium (e.g., a recording sheet). However, the image forming apparatus 1 is not limited to the color copier and may form a color and/or monochrome image with other structure.

The image forming device 1A is provided in a center portion of the image forming apparatus 1 in a vertical direction. The sheet supplier 1B is provided below the image forming device 1A. The original document scanner 1C is provided above the image forming device 1A.

In the image forming device 1A, the intermediate transfer belt 2 includes a horizontal surface extending in a horizontal direction. A structure for forming toner images in colors complementary to separation colors is provided above the intermediate transfer belt 2.

The photoconductors 3Y, 3M, 3C, and 3K are arranged along the horizontal surface of the intermediate transfer belt 2, and carry toner images in complementary colors, that is, yellow, magenta, cyan, and black toner images. The photoconductors 3Y, 3M, 3C, and 3K include drums rotatable in an identical direction, that is, counterclockwise in FIG. 2, respectively. The chargers 4Y, 4M, 4C, and 4K, the writer 5, the development devices 6Y, 6M, 6C, and 6K, the first transfer devices 7Y, 7M, 7C, and 7K, and the cleaners 8Y, 8M, 8C, and 8K surround the photoconductors 3Y, 3M, 3C, and 3K, respectively, to perform image forming processes while the photoconductors 3Y, 3M, 3C, and 3K rotate.

The intermediate transfer belt 2 is looped over a plurality of rollers 2A, 2B, and 2C, and is movable in a direction identical to the direction in which the photoconductors 3Y, 3M, 3C, and 3K rotate at opposing positions at which the intermediate transfer belt 2 opposes the photoconductors 3Y, 3M, 3C and 3K. The rollers 2A and 2B form the horizontal surface of the intermediate transfer belt 2. The roller 2C opposes the second transfer device 9 via the intermediate transfer belt 2. The belt cleaner 10 cleans the intermediate transfer belt 2.

The transfer belt 9C is looped over the driving roller 9A and the driven roller 9B, and is movable in a direction identical to the direction in which the intermediate transfer belt 2 rotates at a second transfer position at which the second transfer device 9 contacts the intermediate transfer belt 2. The driving roller 9A charges the transfer belt 9C to transfer the yellow, magenta, cyan, and black toner images superimposed on the intermediate transfer belt 2 or a monochrome toner image formed on the intermediate transfer belt 2 onto a sheet (e.g., a recording sheet).

The recording sheet is sent to the second transfer position from the sheet supplier 1B. The sheet supplier 1B includes the plurality of sheet trays 1B1, the plurality of conveyance roller pairs 1B2, and the registration roller pair 1B3. The plurality of conveyance roller pairs 1B2 is provided on a conveyance path through which the recording sheet fed from one of the sheet trays 1B1 is conveyed to the second transfer position. The registration roller pair 1B3 is provided upstream from the second transfer position in a sheet conveyance direction.

The sheet supplier 1B further includes the bypass tray 1A1 and the feed roller pair 1A2. The bypass tray 1A1 is provided on one side of the image forming apparatus 1. For example, the bypass tray 1A1 is openable and closable with respect to the image forming apparatus 1 as a part of a wall of the image forming device 1A. Sheets of types other than sheets contained in the sheet trays 1B1 may be set on the bypass tray 1A1. The feed roller pair 1A2 feeds a recording sheet from the bypass tray 1A1 toward the second transfer position. A conveyance path through which the recording sheet is conveyed from the bypass tray 1A1 toward the second transfer position joins the conveyance path through which a recording sheet is conveyed from one of the sheet trays 1B1 toward the second transfer position before the registration roller pair 1B3. The registration roller pair 1B3 stops and feeds whichever sheet to the second transfer position at a proper time.

The writer 5 emits light onto the photoconductors 3Y, 3M, 3C, and 3K according to image data obtained by scanning an image on an original document placed on the exposure glass 101 of the original document scanner 1C or image data output by a client computer to form electrostatic latent images on the photoconductors 3Y, 3M, 3C, and 3K, respectively.

In the original document scanner 1C, the scanner 1C2 exposes and scans the original document placed on the exposure glass 1C1. The auto document feeder 1C3 is provided above the exposure glass 1C1, and includes a structure to reverse the original document to be sent to the exposure glass 1C1 so that the scanner 1C2 scans front and back sides of the original document.

The development devices 6Y, 6M, 6C, and 6K make the electrostatic latent images formed on the photoconductors 3Y, 3M, 3C, and 3K by the writer 5 visible as yellow, magenta, cyan, and black toner images, respectively. The first transfer devices 7Y, 7M, 7C, and 7K first-transfer the yellow, magenta, cyan, and black toner images formed on the photoconductors 3Y, 3M, 3C, and 3K, respectively, onto the intermediate transfer belt 2. When the yellow, magenta, cyan, and black toner images are superimposed on the intermediate transfer belt 2, the second transfer device 9 second-transfers the superimposed toner images onto the recording sheet fed by the registration roller pair 133 to the second transfer position to form a color toner image on the recording sheet. The fixing device 11 fixes the color toner image on the recording sheet.

The path selection pawl 12 is provided downstream from the fixing device 11 in the sheet conveyance direction, and switches a conveyance direction of the recording sheet sent from the fixing device 11 between a direction directed to a conveyance path for conveying the recording sheet to the output tray 13 and a direction directed to the reverse conveyance path RP.

The following describes image forming processes performed in the image forming apparatus 1 having the above-described structure.

The scanner 1C2 exposes and scans an image on an original document placed on the exposure glass 101 to generate image data. The writer 5 emits light onto the photoconductors 3Y, 3M, 3C, and 3K uniformly charged by the chargers 4Y, 4M, 4C, and 4K, respectively, according to the image data generated by the scanner 1C2 or image data sent from an external device such as a client computer to form electrostatic latent images on the photoconductors 3Y, 3M, 3C and 3K. The development devices 6Y, 6M, 6C, and 6K make the electrostatic latent images visible as yellow, magenta, cyan, and black toner images, respectively. Thereafter, the first transfer devices 7Y, 7M, 7C, and 7K first-transfer the yellow, magenta, cyan, and black toner images, respectively, onto the intermediate transfer belt 2 successively in such a manner that the yellow, magenta, cyan, and black toner images are superimposed on the intermediate transfer belt 2. The second transfer device 9 second-transfers the superimposed toner images on the intermediate transfer belt 2 onto a recording sheet sent from one of the sheet trays 1B1 to form a color toner image on the recording sheet.

In a monochrome image mode for forming a monochrome toner image on a recording sheet, one of the photoconductors 3Y, 3M, 3C, and 3K is used to form a monochrome toner image thereon. One of the first transfer devices 7Y, 7M, 7C, and 7K first-transfers the monochrome toner image formed on one of the photoconductors 3Y, 3M, 3C, and 3K onto the intermediate transfer belt 2. Thereafter, the second transfer device 9 second-transfers the monochrome toner image formed on the intermediate transfer belt 2 onto a recording sheet sent from one of the sheet trays 1B1.

The fixing device 11 fixes the color toner image or the monochrome toner image on the recording sheet. The recording sheet bearing the fixed toner image is sent to the output tray 13 or is reversed by the reverse conveyance path RP and sent to the registration roller pair 1B3 again.

Specifically, in the fixing device 11, when the recording sheet bearing the unfixed toner image on the front side thereof enters the fixing device 11, the entry guide plate 21*a* lifts the recording sheet and guides the recording sheet to a nip formed between the fixing belt 22 and the pressing roller 25 by the pressing roller 25 pressing against the guide roller 20 and the rotary roller 21 via the fixing belt 22. The fixing belt 22 and the pressing roller 25 sandwich the recording sheet to apply heat and pressure to the recording sheet to fix the toner image on the recording sheet. The recording sheet is conveyed and nipped between the fixing belt 22 and the pressing roller 25 in a state in which the front side of the recording sheet bearing the unfixed toner image faces the fixing belt 22 and the back side of the recording sheet faces the pressing roller 25. The output guide plate 21*b* guides the recording sheet bearing the fixed toner image, which is discharged from the nip formed between the fixing belt 22 and the pressing roller 25, to the path selection pawl 12.

Figure 3A:
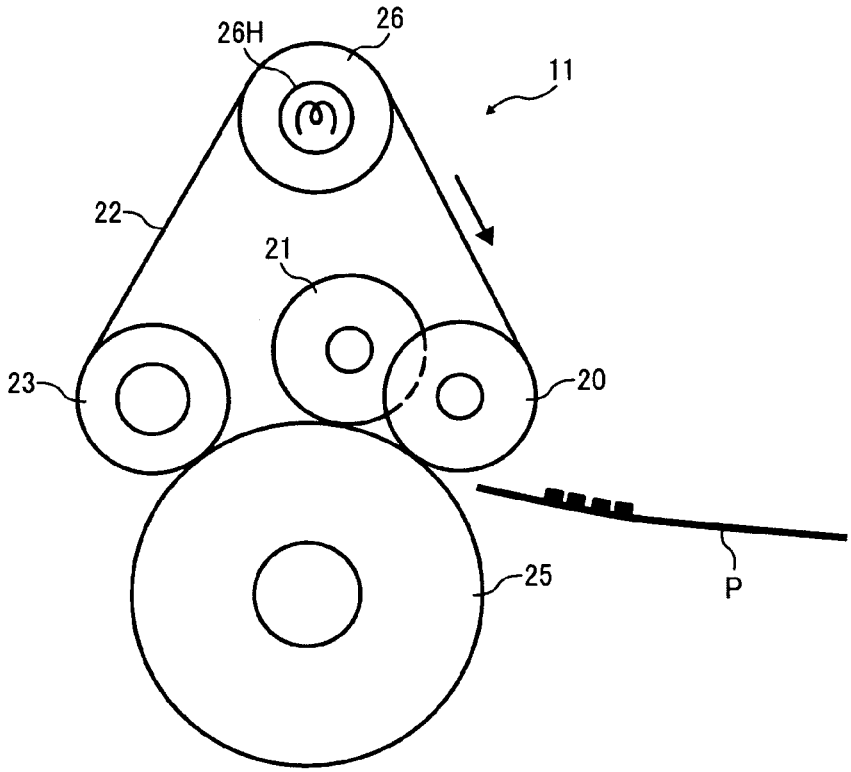
FIG. 3A is a sectional view (according to an example embodiment) of a fixing device included in the image forming apparatus shown in FIG. 2.
Figure 3B:
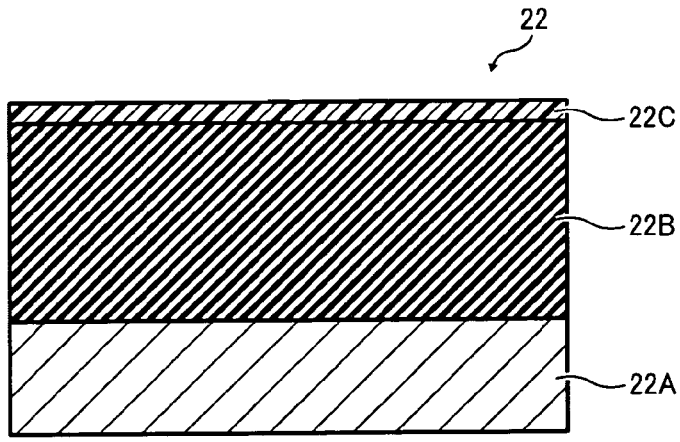
FIG. 3B is a sectional view (according to an example embodiment) of a fixing belt included in the fixing device shown in FIG. 3A.

Referring to FIGS. 3A and 3B, the following describes a fixing process for fixing a toner image on a recording sheet. FIG. 3 is a sectional view of the fixing device 11. As illustrated in FIG. 3A, the fixing device 11 further includes a heater 26H. As illustrated in FIG. 3B, the fixing belt 22 includes a base layer 22A, an elastic layer 22B, and a releasing layer 22C.

As illustrated in FIG. 3A, when a recording sheet P bearing a toner image passes through the fixing device 11, the rotary roller 21 and the heated fixing belt 22 heat and melt toner of the toner image on the recording sheet P until the toner has a decreased viscosity. Pressure applied by the pressing roller 25 penetrates the melted toner into fibers of the recording sheet P. Thereafter, when the toner is cooled and solidified, the toner is solidly adhered to the fibers of the recording sheet P.

In a fixing device installed in an image forming apparatus using conventional color toner, a fixing belt includes silicon rubber having a desired releasing property for separating the toner from the fixing belt as well as heat-resistance and elasticity. Silicon oil is applied to the silicon rubber as a releasing agent to provide the desired releasing property and improved durability of the fixing belt.

Such fixing device uses oilless toner in which wax serving as a releasing agent is dispersed inside a resin base material.

As illustrated in FIG. 3B, the fixing belt 22 includes the base layer 22A including a resin (e.g., polyimide) or a metal sheet (e.g., SUS stainless steel), which has good heat resistance and mechanical strength. The elastic layer 22B (e.g., a cover layer) including silicon rubber having good heat resistance and elasticity is molded to cover the base layer 22A. The releasing layer 22C including a heat-resistant resin having good strength and releasing property and serving as a surface layer is provided on the elastic layer 22B. The releasing layer 22C includes a heat-resistant material of small surface energy. For example, the releasing layer 22C may include a silicon resin, a fluorocarbon resin including a polymeric resin such as polytetrafluoroethylene (PTFE) tetrafluoroethylene-perfluoroalkylvinylether copolymer (PTFE-PFA), and tetrafluoroethylene-hexafluoropropylene copolymer (FEP).

As illustrated in FIG. 3A, the guide roller 20 serving as a first roller, the rotary roller 21 serving as a second roller or a first fixing member, the driving roller 23 serving as a third roller, and the heating roller 26 serving as a fourth roller are provided inside a loop formed by the fixing belt 22 serving as a first belt. The heater 26H serving as a first heater is provided inside the heating roller 26. A driver drives and rotates the driving roller 23. The guide roller 20 guides the fixing belt 22 to the nip formed between the pressing roller 25 and the rotary roller 21.

The pressing roller 25 serving as a pressing member presses against the guide roller 20, the rotary roller 21, and the driving roller 23 via the fixing belt 22 to form a pressing portion, that is, the nip, between the pressing roller 25 and the fixing belt 22.

As illustrated in FIG. 3B, the base layer 22A of the fixing belt 22 may be a heat-resistant resin belt including polyimide and molded to have a thickness in a range of from about 50 μm to about 90 μm, a nickel electroform having a thickness in a range of from about 30 μm to about 50 μm, or a metal belt including SUS stainless steel. The releasing layer 22C including the heat-resistant resin serves as a surface layer and includes PTFE-PFA or PTFE to provide the releasing property required for releasing oilless toner from the fixing belt 22. When the fixing device 11 serves as a fixing device including a belt, which is installed in a color image forming apparatus for forming a color toner image, the elastic layer 22B may be provided between the base layer 22A and the releasing layer 22C to provide sufficient smoothness of a surface of the fixed toner image with respect to recording sheets P having various surface asperities. For example, the elastic layer 22B may be a heat-resistant rubber layer including silicon rubber and having a thickness in a range of from about 100 μm to about 400 μm.

The heating roller 26 may be a thin, hollow, cylindrically shaped metal roller, formed of metal having a desired thermal conductivity, such as aluminum. The halogen heater 26H serving as a heat source is provided inside the heating roller 26. Heat generated by the halogen heater 26H is transmitted to the fixing belt 22 via the heating roller 26. A heat-resistant black coating is applied to an inner circumferential surface of the heating roller 26 to effectively receive and absorb radiation heat from the halogen heater 26H.

A temperature sensor such as a thermistor contacts a surface of the fixing belt 22. The controller C depicted in FIG. 2 controls the surface temperature of the fixing belt 22 at a given temperature.

The driving roller 23 may be a metal roller including aluminum or iron. The driving roller 23 is molded with an elastic layer (e.g., an elastic surface layer) including silicon rubber or silicon rubber foam as a surface layer. The driving roller 23 needs to have a smaller thickness and a greater rubber hardness of the elastic layer to provide a smaller thermal capacity to shorten a warm-up time of the fixing device 11, and greater pressure to prevent a faulty image (e.g., a pearskin image or an orange peel image) which may appear when a toner image has decreased surface smoothness. For example, the elastic layer of the driving roller 23 may have a desired thickness in a range of from about 1 mm to about 5 mm and a rubber hardness in a range of from about 50 Hs to about 90 Hs in ASKER C hardness. In image forming apparatuses providing a shortened warm-up time, the pressing roller 25 may be formed of one or more materials having a low thermal conductivity, such as silicon rubber foam.

The driving roller 23 presses against and engages the pressing roller 25 a given amount so that the elastic layer of the driving roller 23 and an elastic layer of the pressing roller 25 form a nip between the driving roller 23 and the pressing roller 25.

The pressing roller 25 may be a metal roller including a metal core including a metal such as aluminum or iron and a releasing layer as a surface layer. The releasing layer includes PFA or PTFE to provide good separation of the oilless toner from the pressing roller 25 when a toner image formed on the back side of the recording sheet P contacts the pressing roller 25 in a duplex printing mode. When the fixing device 11 is installed in the image forming apparatus 1 for forming a color toner image, an elastic layer is provided between the metal core and the releasing layer of the pressing roller 25 to provide sufficient smoothness on a surface of the fixed toner image formed on recording sheets P having various surface asperities. The elastic layer may be a heat-resistant rubber layer including silicon rubber and having a thickness in a range of from about 0.2 mm to about 1.0 mm. The thickness of the rubber layer needs to be not greater than an upper limit corresponding to a thermal capacity of the pressing roller 25, which varies depending on the warm-up time of the fixing device 11. Accordingly, the thickness of the rubber layer strikes a balance between image quality and warm-up time.

According to this example embodiment, no heat source is provided near the pressing roller 25. Alternatively, however, a halogen heater serving as a heat source may be provided inside the pressing roller 25.

The pressing roller 25 is rotatably supported by a side plate of the fixing device 11 via a bearing or the like. A rotary axis of the pressing roller 25 is fixed in the fixing device 11, and a driver drives and rotates the pressing roller 25 via gears.

The guide roller 20 and the rotary roller 21 include layers equivalent to the layers of the driving roller 23 including the above-described materials.

The rotating guide roller 20 guides a recording sheet P to an entry to the nip formed between the pressing roller 25 and the fixing belt 22. The rotating driving/roller 23 rotates the fixing belt 22 at the nip. The guide roller 20 has a roller shape to stabilize the fixing belt 22 by rotation of the guide roller 20. If the guide roller 20 has a shape other than the roller shape and is fixed in the fixing device 11, a greater load is applied to the guide roller 20, resulting in slippage of the fixing belt 22 on the guide roller 20, a greater load torque applied to the guide roller 20, and degraded durability of the guide roller 20.

Figure 4B:
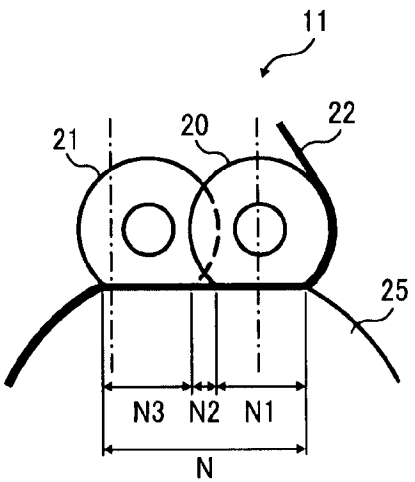
FIG. 4B is a sectional view (according to an example embodiment) of the guide roller and the rotary roller shown in FIG. 4A seen in a direction E shown in FIG. 4A.
Figure 4A:
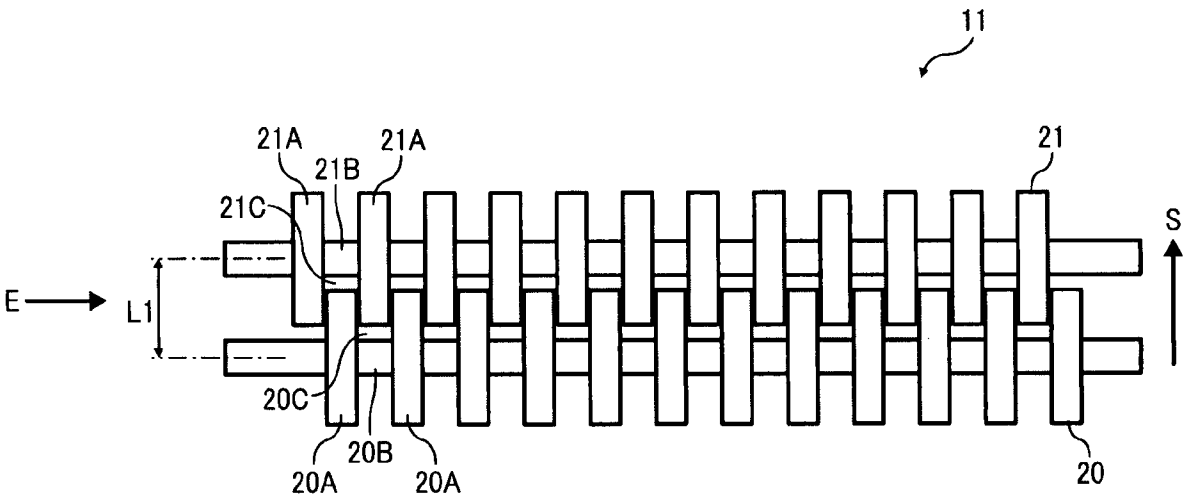
FIG. 4A is a top view (according to an example embodiment) of a guide roller and a rotary roller included in the fixing device shown in FIG. 3A.

Referring to FIGS. 4A and 4B, the following describes the guide roller 20 and the rotary roller 21. FIG. 4A is a top view of the guide roller 20 and the rotary roller 21. FIG. 4B is a sectional view of the guide roller 20 and the rotary roller 21 seen in a direction E depicted in FIG. 4A. As illustrated in FIG. 4A, the guide roller 20 includes an enlarged radius portion 20A, a reduced radius portion 20B, and a gap portion 20C. The rotary roller 21 includes an enlarged radius portion 21A, a reduced radius portion 21B, and a concave gap portion 21C.

As illustrated in FIG. 4A, the guide roller 20 is provided upstream from the rotary roller 21 in a sheet conveyance direction S corresponding to a moving direction or a rotation direction of the fixing belt 22 depicted in FIG. 3A.

As illustrated in FIG. 1B, in the related-art fixing device 11R, the pressing member 25R equivalent to the pressing roller 25 depicted in FIG. 3A presses against the first roller 20R via the belt 22R at the nip section N1, and presses against the second roller 21R via the belt 22R at the nip section N3. By contrast, at the nip section N2, the pressing member 25R presses against the belt 22R, and does not press against the first roller 20R and the second roller 21R. Accordingly, at the nip section N2, the pressing member 25R presses a recording sheet P against the belt 22R with smaller pressure. In other words, the recording sheet P contacts the belt 22R with uneven pressure applied between the pressing member 25R and the belt 22R.

Figure 1A:
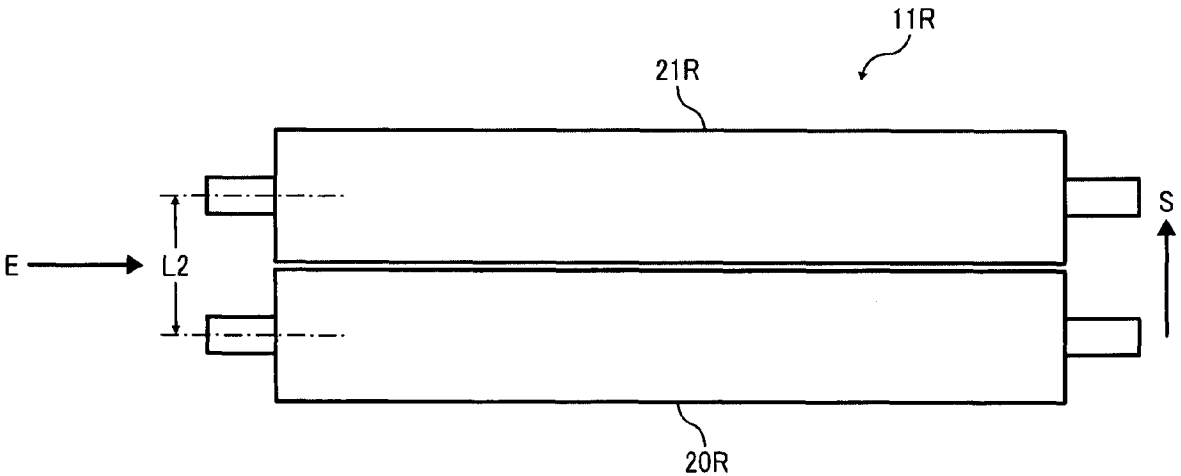
FIG. 1A RELATED ART
FIG. 1A is a schematic top view of a related-art fixing device.

To address this problem, the length of the nip section N2 may be shortened. However, as illustrated in FIGS. 1A and 1B, in the related-art fixing device 11R, the length of the nip section N2 corresponds to a distance L2 between a rotation axis of the first roller 20R and a rotation axis of the second roller 21R, and therefore is not smaller than the total length of the maximum radius of the first roller 20R and the maximum radius of the second roller 21R.

To address this problem, the radius of the first roller 20R and the second roller 21R may be shortened to shorten the length of the nip section N2. However, the total length of the nip sections N1 to N3 is shortened, and therefore the recording sheet P is not heated for the desired length of time. To address this problem, greater pressure may be applied at the nip sections N1 to N3. However, the smaller radius of the first roller 20R and the second roller 21R causes pressure applied at a center portion of the first roller 20R and the second roller 21R in an axial direction of the first roller 20R and the second roller 21R to be smaller, resulting in increased variation of nip width or pressure.

According to this example embodiment, the guide roller 20 includes the gap portion 20C and the rotary roller 21 includes the gap portion 21C as illustrated in FIG. 4A. The gap portion 20C is formed by the reduced radius portion 20B and the enlarged radius portions 20A sandwiching the reduced radius portion 20B. Similarly, the gap portion 21C is formed by the reduced radius portion 21B and the enlarged radius portions 21A sandwiching the reduced radius portion 21B. The enlarged radius portion 21A of the rotary roller 21 is inserted into and interdigitates the gap portion 20C of the guide roller 20 with play between the rotary roller 21 and the guide roller 20. Similarly, the enlarged radius portion 20A of the guide roller 20 is inserted into and interdigitates the gap portion 21C of the rotary roller 21 with play between the guide roller 20 and the rotary roller 21. Thus, the guide roller 20 and the rotary roller 21 are interdigitated without contacting each other. Accordingly, a distance LI between a rotation axis of the guide roller 20 and a rotation axis of the rotary roller 21 can be made smaller than the distance L2 between the rotation axis of the first roller 20R and the rotation axis of the second roller 21R illustrated in FIG. 1A of the related art. Moreover, this is so even when the guide roller 20 and the first roller 20R have an identical radius and the rotary roller 21 and the second roller 21R have an identical radius. Consequently, the length of the intermediate nip section N2 between the rotation axis of the guide roller 20 and the rotation axis of the rotary roller 21 is shortened so that the pressing roller 25 presses the recording sheet P against the fixing belt 22 at the nip section N2 stably.

A gap between the enlarged radius portion 20A of the guide roller 20 and the reduced radius portion 21B of the rotary roller 21 provided opposite each other may be adjusted by using the rigidity of the fixing belt 22 to provide stable pressure distribution. The fixing belt 22 may include a rigid material such as a metal belt to provide stable pressure distribution for pressing the recording sheet P against the fixing belt 22. Thus, the recording sheet P is pressed against the fixing belt 22 effectively.

Figure 5B:
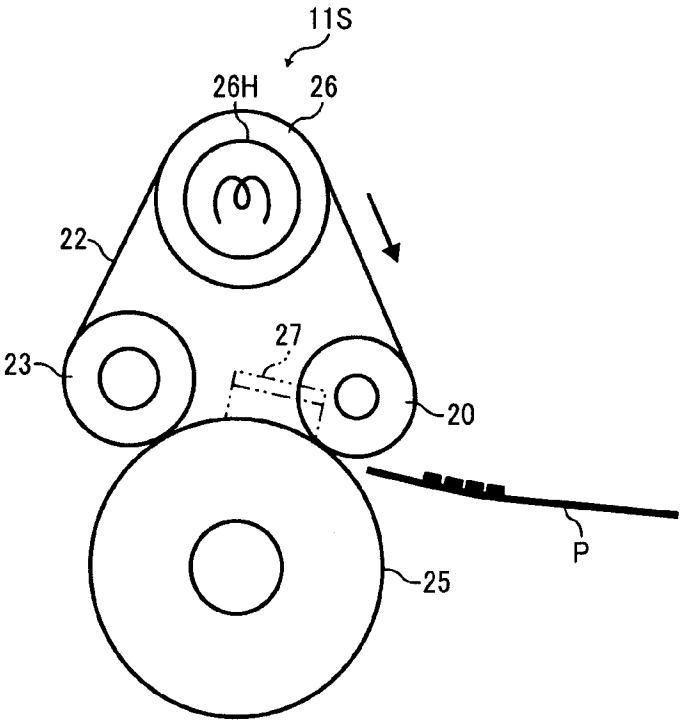
FIG. 5B is a sectional view (according to an example embodiment) of the fixing device shown in FIG. 5A.
Figure 5A:
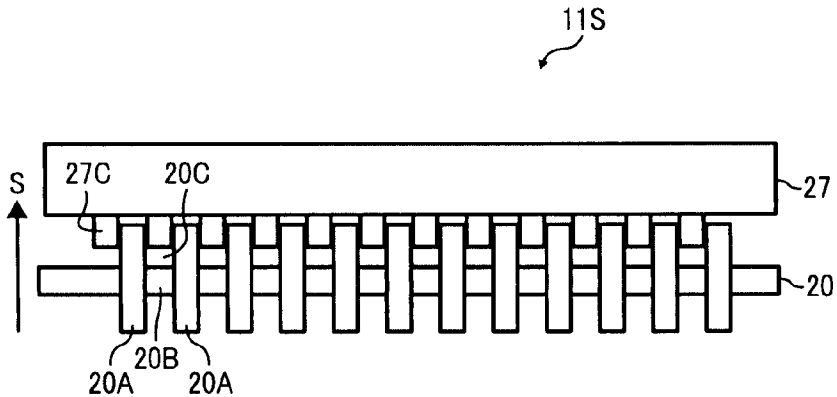
FIG. 5A is a top view of a fixing device according to another example embodiment.

Referring to FIGS. 5A and 5B, the following describes a fixing device 11S according to another example embodiment. FIG. 5A is a top view of the fixing device 11S. FIG. 5B is a sectional view of the fixing device 11S. As illustrated in FIGS. 5A and 5B, the fixing device 11S includes a pad 27. The pad 27 includes a protrusion portion 27C. The pad 27 replaces the rotary roller 21 depicted in FIG. 3 A. The other elements of the fixing device 11S are equivalent to the elements of the fixing device 11 depicted in FIG. 3 A.

As illustrated in FIG. 5B, the pad 27 (e.g., a stationary pad) serves as a stationary member which is fixed in the fixing device 11S, a pressing member which presses against the recording sheet P via the fixing belt 22, or a first fixing member which presses the recording sheet P against the pressing roller 25 via the fixing belt 22 to fix a toner image on the recording sheet P. The guide roller 20 and the pad 27 are provided inside the loop formed by the fixing belt 22.

As illustrated in FIG. 5A, the guide roller 20 includes the plurality of gap portions 20C, each of which is formed by the reduced radius portion 20B and the enlarged radius portions 20A sandwiching the reduced radius portion 20B. In other words, the enlarged radius portion 20A and the reduced radius portion 20B are arranged alternately. The plurality of protrusion portions 27C protrudes from one edge surface of the pad 27 facing the guide roller 20. The protrusion portion 27C of the pad 27 is inserted into the gap portion 20C of the guide roller 20 with play between the protrusion portion 27C and the gap portion 20C.

The pad 27 includes an elastic material such as silicon rubber or silicon rubber foam which is adhered to a resin holder including a heat-resistant resin with a heat-resistant adhesive, for example. The pad 27 further includes a low friction member which contacts the fixing belt 22 to reduce resistance generated between the pad 27 and the fixing belt 22 sliding over the pad 27.

Like the guide roller 20 and the rotary roller 21 of the fixing device 11 depicted in FIG. 4A, the guide roller 20 and the pad 27 are complementary to each other or interdigitated with each other, and press against the pressing roller 25 via the fixing belt 22 to form a nip between the pressing roller 25 and the fixing belt 22. Thus, the pad 27 inserted into the guide roller 20 with play therebetween forms the long nip stably.

Figure 6:
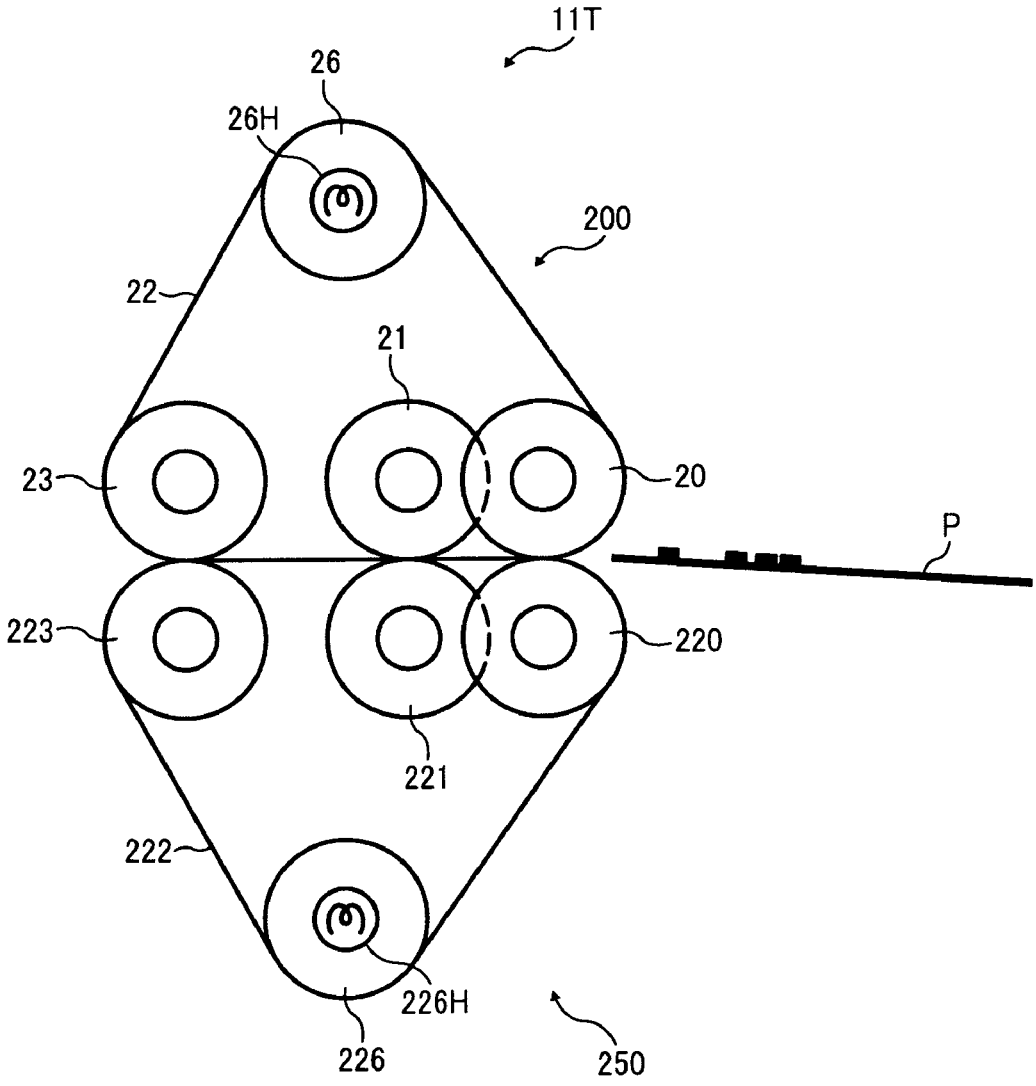
FIG. 6 is a sectional view of a fixing device according to yet another example embodiment.

Referring to FIG. 6, the following describes a fixing device 11T according to yet another example embodiment. FIG. 6 is a sectional view of the fixing device 11T. As illustrated in FIG. 6, the fixing device 11T includes a heating unit 200 and a pressing unit 250. The heating unit 200 includes the guide roller 20, the rotary roller 21, the fixing belt 22, the driving roller 23, the heating roller 26, and the heater 26H. The pressing unit 250 includes a guide roller 220, a rotary roller 221, a pressing belt 222, a driving roller 223, a heating roller 226, and a heater 226H.

The heating unit 200 has the structure equivalent to the structure of the guide roller 20, the rotary roller 21, the fixing belt 22, the driving roller 23, the heating roller 26, and the heater 26H illustrated in FIG. 3A. The pressing unit 250 replaces the pressing roller 25 depicted in FIG. 3A, and has the structure equivalent to the structure of the heating unit 200.

The guide roller 20 and the rotary roller 21 are provided inside the loop formed by the endless fixing belt 22. Similarly, the guide roller 220 serving as a fifth roller and the rotary roller 221 serving as a second fixing member are provided inside a loop formed by the endless pressing belt 222 serving as a pressing member or a second belt. Thus, the heating unit 200 and the pressing unit 250 having the identical structure form a substantially flat nip. Accordingly, the heating unit 200 and the pressing unit 250 have an identical curvature to form a conveyance path through which the recording sheet P is conveyed. In other words, the conveyance path of the recording sheet P corresponds to a moving route of the fixing belt 22 to suppress difference between the conveyance path of the recording sheet P and the moving route of the fixing belt 22, preventing image shift of the fixed toner image on the recording sheet P.

The heater 226H serving as a second heater is provided inside the heating roller 226 provided inside the loop formed by the pressing belt 222.

Figure 7A:
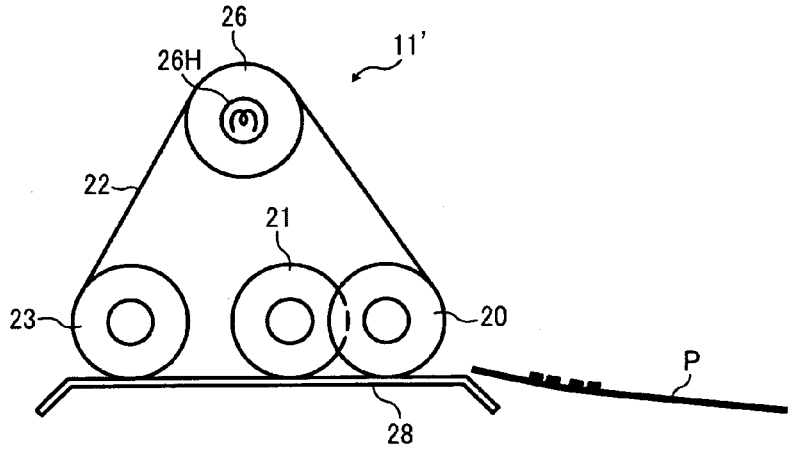
FIG. 7A is a sectional view of a fixing device according to yet another example embodiment.

Referring to FIG. 7A, the following describes a fixing device 11' according to yet another example embodiment. FIG. 7A is a sectional view of the fixing device 11'. As illustrated in FIG. 7A, the fixing device 11' includes a plate 28. The plate 28 replaces the pressing roller 25 depicted in FIG. 3A. The other elements of the fixing device 11' are equivalent to the elements of the fixing device 11 depicted in FIG. 3A.

The plate 28 serves as a pressing member for pressing against the guide roller 20, the rotary roller 21, and the driving roller 23 via the fixing belt 22 to form a nip between the fixing belt 22 and the plate 28.

Figure 7B:
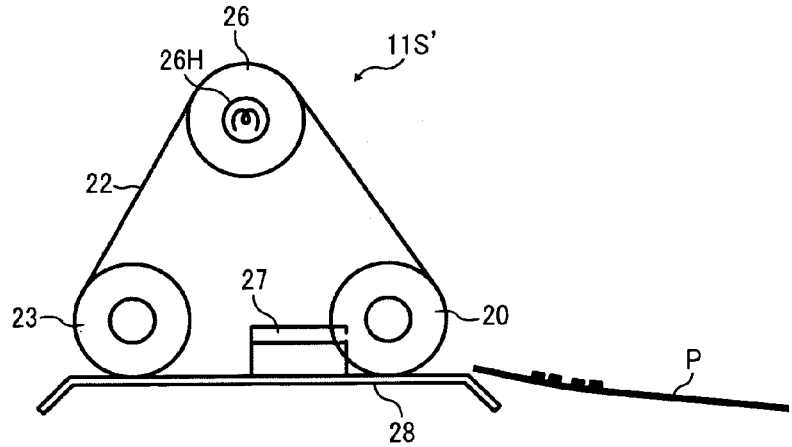
FIG. 7B is a sectional view of a fixing device according to yet another example embodiment.

Referring to FIG. 7B, the following describes a fixing device 11S' according to yet another example embodiment. FIG. 7B is a sectional view of the fixing device 11S'. As illustrated in FIG. 7B, the fixing device 11S' includes the plate 28. The plate 28 replaces the pressing roller 25 depicted in FIG. 5B. The other elements of the fixing device 11S' are equivalent to the elements of the fixing device 11S depicted in FIG. 5B.

The plate 28 serves as a pressing member for pressing against the guide roller 20, the pad 27, and the driving roller 23 via the fixing belt 22 to form a nip between the fixing belt 22 and the plate 28.

Figure 7C:
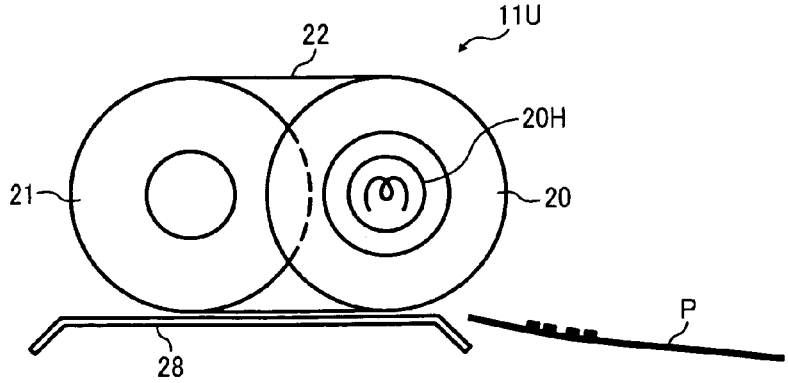
FIG. 7C is a sectional view of a fixing device according to yet another example embodiment.

Referring to FIG. 7C, the following describes a fixing device 11U according to yet another example embodiment. FIG. 7C is a sectional view of the fixing device 11U. As illustrated in FIG. 7C, the fixing device 11U includes the guide roller 20, a heater 20H, the rotary roller 21, the fixing belt 22, and the plate 28.

The plate 28 serves as a pressing member for pressing against the guide roller 20 and the rotary roller 21 via the fixing belt 22 to form a nip between the fixing belt 22 and the plate 28.

The guide roller 20 and the rotary roller 21 are arranged as described above by referring to FIGS. 4A and 4B. The pair of rollers, that is, the guide roller 20 and the rotary roller 21, is provided inside the loop formed by the fixing belt 22. In other words, the fixing belt 22 is laid over the two rollers to provide the compact fixing device 11U. Accordingly, the fixing device 11U has a decreased thermal capacity and is heated within shortened time, saving energy.

The heater 20H serving as a first heater is provided inside the guide roller 20.

The fixing devices 11', 11S', and 11U depicted in FIGS. 7A, 7B, and 7C, respectively, provide effects equivalent to the effects provided by the fixing device 11 depicted in FIG. 4A or the fixing device 11S depicted in FIG. 5A.

Figure 8A:
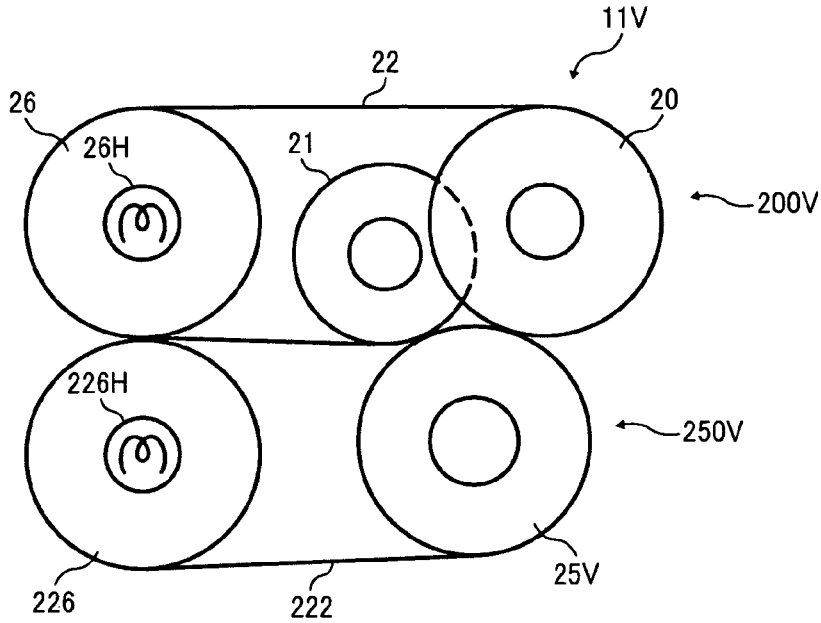
FIG. 8A is a sectional view of a fixing device according to yet another example embodiment.

Referring to FIG. 8A, the following describes a fixing device 11V according to yet another example embodiment. FIG. 8A is a sectional view of the fixing device 11V. As illustrated in FIG. 8A, the fixing device 11V includes a fixing unit 200V and a pressing unit 250V. The fixing unit 200V includes the guide roller 20, the rotary roller 21, the fixing belt 22, the heating roller 26, and the heater 26H. The pressing unit 250V includes a pressing roller 25V, the pressing belt 222, the heating roller 226, and the heater 226H.

In the fixing device 11V, each of the fixing unit 200V and the pressing unit 250V includes a heater. For example, the heater 26H serving as a first heater is provided inside the heating roller 26. The heater 226H serving as a second heater is provided inside the heating roller 226 provided inside the loop formed by the pressing belt 222.

The guide roller 20 and the rotary roller 21 are provided inside the loop formed by the fixing belt 22, and arranged like the guide roller 20 and the rotary roller 21 depicted in FIG. 4B. The pressing unit 250V includes two rollers, that is, the pressing roller 25V and the heating roller 226, and presses against the fixing belt 22 of the fixing unit 200V to form a nip between the fixing belt 22 serving as a first belt and the pressing belt 222 serving as a second belt.

Figure 8B:
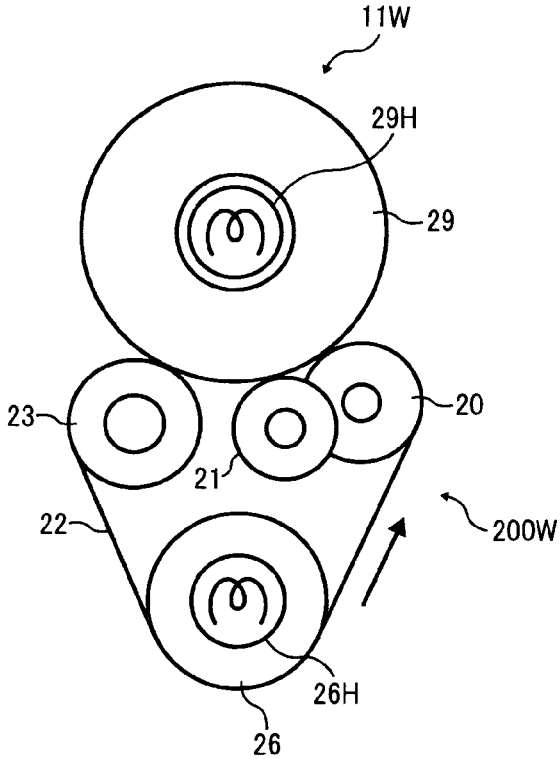
FIG. 8B is a sectional view of a fixing device according to yet another example embodiment.

Referring to FIG. 8B, the following describes a fixing device 11W according to yet another example embodiment. FIG. 8B is a sectional view of the fixing device 11W. As illustrated in FIG. 8B, the fixing device 11W includes a pressing roller 29, a heater 29H, and a fixing unit 200W. The fixing unit 200W includes the guide roller 20, the rotary roller 21, the fixing belt 22, the driving roller 23, the heating roller 26, and the heater 26H.

In the fixing device 11W, each of the fixing unit 200W and the pressing roller 29 includes a heater. For example, the heater 26H serving as a first heater is provided inside the loop formed by the fixing belt 22 and inside the heating roller 26. The heater 29H serving as a second heater is provided inside the pressing roller 29 serving as a pressing member. In other words, the structure of the fixing device 11W is equivalent to the structure of the fixing device 11 depicted in FIG. 3A except that the heater 29H is provided inside the pressing roller 29.

The fixing devices 11V and 11W depicted in FIGS. 8A and 8B, respectively, provide effects equivalent to the effects provided by the fixing device 11 depicted in FIG. 3A.

In other words, any structure in which the two rollers, that is, the guide roller and the rotary roller, are provided complementary to each other or interdigitated with each other to form the nip sections N1, N2, and N3 depicted in FIG. 4B successively in the sheet conveyance direction S may provide the effects provided by the fixing device 11 depicted in FIG. 3A.

According to the above-described example embodiments, the halogen heater is used as the heater 20H, 26H, 29H, or 226H. Alternatively, an induction heater or other heater may be used as the heater. Further, the heater may be disposed at a position other than the positions specified in the above-described example embodiments and may heat the fixing device by other heating method.

The fixing devices according to the above-described example embodiments heat and melt a toner image on a recording sheet by applying heat to the toner image. Alternatively, other methods may be used as long as pressure is applied to softened, fine particles of the toner image to adhere the particles to the recording sheet. For example, liquid for softening toner of the toner image may be applied to the recording sheet before the recording sheet is conveyed to the fixing device or when pressure is applied to the recording sheet at the nip.

Referring to FIGS. 9A, 9B, 9C, 9D, and 9E, the following describes variations of the guide roller 20 and the rotary roller 21 depicted in FIG. 4A. FIGS. 9A, 9B, 9C, 9D, and 9E illustrate a top view of the guide roller 20 and the rotary roller 21.

In FIG. 4A, the enlarged radius portions 20A of the guide roller 20 and the enlarged radius portions 21A of the rotary roller 21 are arranged parallel to the sheet conveyance direction S corresponding to the moving direction or the rotation direction of the fixing belt 22. Alternatively, various arrangements of the enlarged radius portions 20A of the guide roller 20 and the enlarged radius portions 21A of the rotary roller 21 may be used as illustrated in FIGS. 9A, 9B, 9C, 9D, and 9E. In FIGS. 9A, 9B, 9C, 9D, and 9E also, the rotary roller 21 serving as a first fixing member or a second roller is adjacent to the guide roller 20 serving as a first roller, and the enlarged radius portion 21A of the rotary roller 21 is inserted into the gap portion 20C (depicted in FIG. 4A) of the guide roller 20 with play between the guide roller 20 and the rotary roller 21 to form the continuous nip sections N1, N2, and N3 as illustrated in FIG. 4B.

Figure 9A:
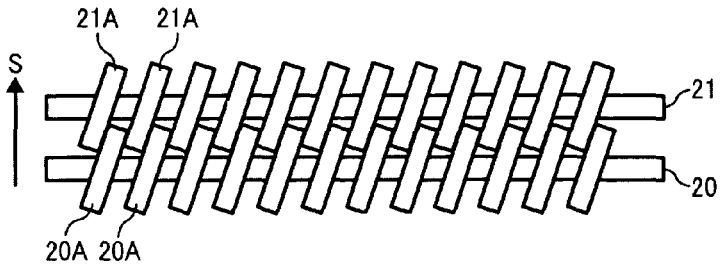
FIG. 9A is a top view (according to an example embodiment) illustrating a variation of the guide roller and the rotary roller shown in FIG. 4A.

FIG. 9A illustrates a first variation of the guide roller 20 and the rotary roller 21. The enlarged radius portions 20A of the guide roller 20 and the enlarged radius portions 21A of the rotary roller 21 in an entire axial direction of the guide roller 20 and the rotary roller 21 are tilted with respect to the sheet conveyance direction S in an identical direction. Accordingly, the enlarged radius portions 20A of the guide roller 20 partially coincide with the enlarged radius portions 21A of the rotary roller 21 in cross-section.

Figure 9B:
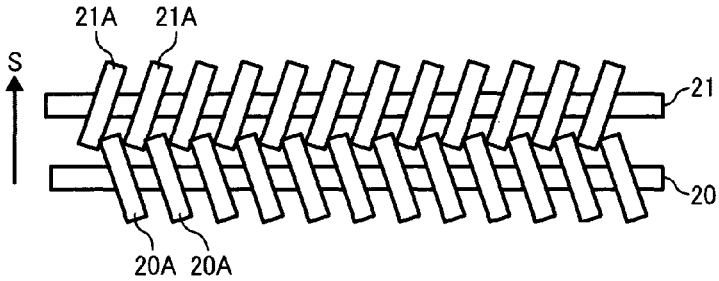
FIG. 9B is a top view (according to an example embodiment) illustrating another variation of the guide roller and the rotary roller shown in FIG. 4A.

FIG. 9B illustrates a second variation of the guide roller 20 and the rotary roller 21. The enlarged radius portions 20A of the guide roller 20 and the enlarged radius portions 21A of the rotary roller 21 in the entire axial direction of the guide roller 20 and the rotary roller 21 are tilted with respect to the sheet conveyance direction S in directions opposite to each other. Accordingly, the enlarged radius portions 20A of the guide roller 20 partially coincide with the enlarged radius portions 21A of the rotary roller 21 in cross-section.

Figure 9C:
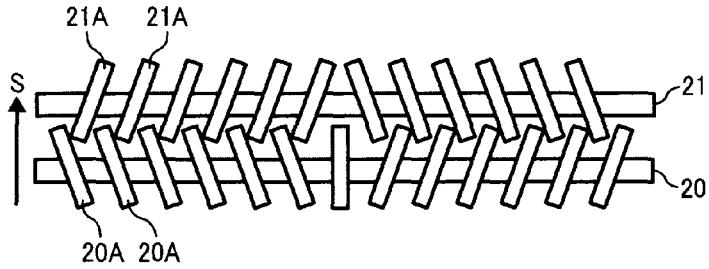
FIG. 9C is a top view (according to an example embodiment) illustrating yet another variation of the guide roller and the rotary roller shown in FIG. 4A.

FIG. 9C illustrates a third variation of the guide roller 20 and the rotary roller 21. The guide roller 20 is divided into a first section and a second section by a center of the guide roller 20 in the axial direction of the guide roller 20. Similarly, the rotary roller 21 is divided into a first section and a second section by a center of the rotary roller 21 in the axial direction of the rotary roller 21. In the first section on the left of the center of the guide roller 20, the enlarged radius portions 20A are tilted leftward toward a left end of the guide roller 20 with respect to the sheet conveyance direction S. In the second section on the right of the center of the guide roller 20, the enlarged radius portions 20A are tilted rightward toward a right end of the guide roller 20 with respect to the sheet conveyance direction S. By contrast, in the first section on the left of the center of the rotary roller 21, the enlarged radius portions 21A are tilted rightward toward the center of the rotary roller 21 with respect to the sheet conveyance direction S. In the second section on the right of the center of the rotary roller 21, the enlarged radius portions 21A are tilted leftward toward the center of the rotary roller 21 with respect to the sheet conveyance direction S. Accordingly, the enlarged radius portions 20A of the guide roller 20 partially coincide with the enlarged radius portions 21A of the rotary roller 21 in cross-section.

Figure 9D:
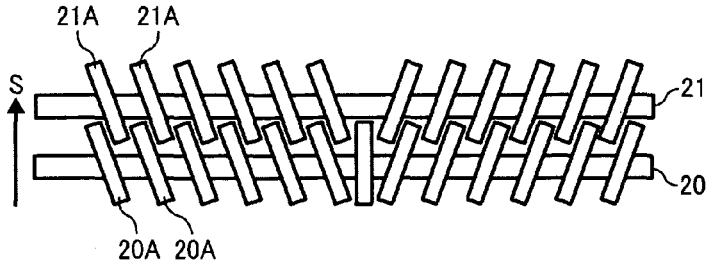
FIG. 9D is a top view (according to an example embodiment) illustrating yet another variation of the guide roller and the rotary roller shown in FIG. 4A.

FIG. 9D illustrates a fourth variation of the guide roller 20 and the rotary roller 21. Like the guide roller 20 depicted in FIG. 9C, in the first section on the left of the center of the guide roller 20, the enlarged radius portions 20A are tilted leftward toward the left end of the guide roller 20 with respect to the sheet conveyance direction S. In the second section on the right of the center of the guide roller 20, the enlarged radius portions 20A are tilted rightward toward the right end of the guide roller 20 with respect to the sheet conveyance direction S. Similarly, in the first section on the left of the center of the rotary roller 21, the enlarged radius portions 21A are tilted leftward toward the left end of the rotary roller 21 with respect to the sheet conveyance direction S. In the second section on the right of the center of the rotary roller 21, the enlarged radius portions 21A are tilted rightward toward the right end of the rotary roller 21 with respect to the sheet conveyance direction S. Accordingly, the enlarged radius portions 20A of the guide roller 20 partially coincide with the enlarged radius portions 21A of the rotary roller 21 in cross-section.

Figure 9E:
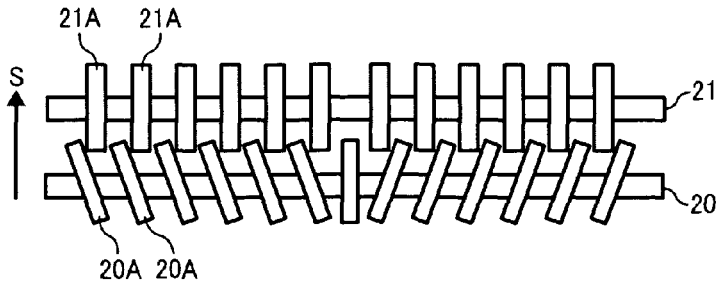
FIG. 9E is a top view (according to an example embodiment) illustrating yet another variation of the guide roller and the rotary roller shown in FIG. 4A.

FIG. 9E illustrates a fifth variation of the guide roller 20 and the rotary roller 21. Like the guide roller 20 depicted in FIG. 9C, in the first section on the left of the center of the guide roller 20, the enlarged radius portions 20A are tilted leftward toward the left end of the guide roller 20 with respect to the sheet conveyance direction S. In the second section on the right of the center of the guide roller 20, the enlarged radius portions 20A are tilted rightward toward the right end of the guide roller 20 with respect to the sheet conveyance direction S. However, the enlarged radius portions 21A of the rotary roller 21 are arranged parallel to the sheet conveyance direction S. Accordingly, the enlarged radius portions 20A of the guide roller 20 partially coincide with the enlarged radius portions 21A of the rotary roller 21 in cross-section.

As illustrated in FIGS. 9A, 9B, 9C, 9D, and 9E, the enlarged radius portions 20A and the enlarged radius portions 21A which are tilted with respect to the sheet conveyance direction S press the recording sheet P against the pressing roller 25 via the fixing belt 22 (depicted in FIG. 3A) precisely. In other words, the tilted enlarged radius portions 20A and the tilted enlarged radius portions 21A press the fixing belt 22 and the recording sheet P against the pressing roller 25 to heat and melt a toner image on the recording sheet P stably to fix the toner image on the recording sheet P, thus preventing image shift on the recording sheet P. Further, the tilted enlarged radius portions 20A and the tilted enlarged radius portions 21A suppress twisting of the fixing belt 22 as the fixing belt 22 rotates, improving conveyance performance of the fixing belt 22 for conveying the recording sheet P.

In a fixing device according to the above-described example embodiments (e.g., the fixing device 11, 11S, 11T, 11', 11S', 11U, 11V, or 11W depicted in FIG. 3A, 5A, 6, 7A, 7B, 7C, 8A, or 8B, respectively), a first roller (e.g., the guide roller 20 depicted in FIG. 3A, 5A, 6, 7A, 7B, 7C, 8A, 8B, 9A, 9B, 9C, 9D, or 9E) and a first fixing member (e.g., the rotary roller 21 depicted in FIG. 3A, 6, 7A, 7C, 8A, 8B, 9A, 9B, 9C, 9D, or 9E or the pad 27 depicted in FIG. 5A or 7B) are provided inside a loop formed by a first belt (e.g., the fixing belt 22 depicted in FIG. 3A, 5B, 6, 7A, 7B, 7C, 8A, or 8B). A distance between the first roller and the first fixing member disposed adjacent to the first roller is shortened to press a recording sheet against a pressing member (e.g., the pressing roller 25 depicted in FIG. 3A or 5B, the pressing roller 29 depicted in FIG. 8B, the pressing belt 222 depicted in FIG. 6, the pressing belt 222 depicted in FIG. 8A, or the plate 28 depicted in FIG. 7A, 7B, or 7C) via the first belt stably to suppress image shift of a toner image on the recording sheet, resulting in the compact fixing device. Accordingly, the first belt has a smaller thermal capacity to save energy.

The compact fixing device is heated to a desired temperature within shortened time without shortening life of the elements of the fixing device. Further, the first belt for conveying the recording sheet contacts the recording sheet stably to prevent image shift of the toner image on the recording sheet which may appear on a faulty toner image formed by the fixing device using the first belt.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device comprising:

an endless first belt to rotate in a predetermined direction of rotation;

a first roller provided inside a loop formed by the first belt;

a first fixing member provided inside the loop formed by the first belt and disposed adjacent to the first roller; and a pressing member pressed against the first roller and the first fixing member via the first belt, the first roller comprising:

at least two enlarged radius portions of enlarged radius arranged axially along the first roller;

at least one reduced radius portion of reduced radius sandwiched between the adjacent two enlarged radius portions in an axial direction of the first roller; and a gap portion formed by the reduced radius portion and the adjacent two enlarged radius portions sandwiching the reduced radius portion, the first fixing member interdigitated with the first roller with play between the first fixing member and the first roller.

2. The fixing device according to claim 1, wherein the first fixing member comprises a second roller comprising:

at least two enlarged radius portions of enlarged radius arranged axially along the second roller;

at least one reduced radius portion of reduced radius sandwiched between the adjacent two enlarged radius portions in an axial direction of the second roller; and a gap portion formed by the reduced radius portion and the adjacent two enlarged radius portions sandwiching the reduced radius portion, and wherein the enlarged radius portion of the first roller is inserted into the gap portion of the second roller with play between the first roller and the second roller, and the enlarged radius portion of the second roller is inserted into the gap portion of the first roller with play between the second roller and the first roller.

3. The fixing device according to claim 2, further comprising a third roller provided downstream from the first fixing member in the direction of rotation of the first belt to support the first belt.

4. The fixing device according to claim 3, wherein the third roller presses against the pressing member via the first belt.

5. The fixing device according to claim 3, further comprising a fourth roller provided downstream from the third roller in the direction of rotation of the first belt to support the first belt.

6. The fixing device according to claim 5, further comprising a first heater provided inside at least one of the first roller, the second roller, the third roller, and the fourth roller.

7. The fixing device according to claim 2, wherein the enlarged radius portions of the first roller are tilted with respect to the direction of rotation of the first belt.

8. The fixing device according to claim 7, wherein the enlarged radius portions of the second roller are tilted with respect to the direction of rotation of the first belt.

9. The fixing device according to claim 1, wherein the first fixing member comprises a pad comprising a convex protrusion portion protruding from one edge surface of the pad facing the first roller, the protrusion portion of the pad being inserted into the gap portion of the first roller with play between the pad and the first roller.

10. The fixing device according to claim 1, wherein the pressing member comprises a pressing roller provided outside the loop formed by the first belt and pressed against the first roller and the first fixing member via the first belt.

11. The fixing device according to claim 1, wherein the pressing member comprises a plate provided outside the loop formed by the first belt and pressed against the first roller and the first fixing member via the first belt.

12. The fixing device according to claim 1, wherein the pressing member comprises an endless second belt to rotate in the predetermined direction of rotation, the second belt being provided outside the loop formed by the first belt and pressed against the first roller and the first fixing member via the first belt.

13. The fixing device according to claim 12, further comprising:

a fifth roller provided inside a loop formed by the second belt; and a second fixing member provided inside the loop formed by the second belt and disposed adjacent to the fifth roller, the fifth roller comprising:

at least two enlarged radius portions of enlarged radius arranged axially along the fifth roller;

at least one reduced radius portion of reduced radius sandwiched between the adjacent two enlarged radius portions in an axial direction of the fifth roller; and a gap portion formed by the reduced radius portion and the adjacent two enlarged radius portions sandwiching the reduced radius portion, the second fixing member interdigitated with the fifth roller with play between the second fixing member and the fifth roller.

14. The fixing device according to claim 1, further comprising a second heater provided inside the pressing member.

15. The fixing device according to claim 1, wherein the first belt comprises a multilayer structure including a base layer including metal.

16. An image forming apparatus comprising the fixing device according to claim 1.

* * * * *